US012514303B1

(12) United States Patent
Zuo

(10) Patent No.: US 12,514,303 B1
(45) Date of Patent: Jan. 6, 2026

(54) BRA

(71) Applicant: Dongjing Zuo, Yancheng (CN)

(72) Inventor: Dongjing Zuo, Yancheng (CN)

( * ) Notice: Subject to any disclaimer, the term of this patent is extended or adjusted under 35 U.S.C. 154(b) by 0 days.

(21) Appl. No.: 19/212,829

(22) Filed: May 20, 2025

(30) Foreign Application Priority Data

May 6, 2025 (CN) ..... 202520874760.9

(51) Int. Cl.
*A41C 3/04* (2006.01)
*A41D 1/215* (2018.01)

(52) U.S. Cl.
CPC ..... *A41C 3/04* (2013.01); *A41D 1/215* (2018.01)

(58) Field of Classification Search
CPC ..... A41C 3/04
USPC ..... 450/38
See application file for complete search history.

(56) References Cited

U.S. PATENT DOCUMENTS

2019/0142078 A1* 5/2019 Kosak ..... A41F 1/006 450/36
2022/0304395 A1* 9/2022 Stanton ..... A41C 3/12
2023/0338631 A1* 10/2023 Stanton ..... A41C 3/02

FOREIGN PATENT DOCUMENTS

CN 204733929 U 11/2015
CN 106605966 A 5/2017
CN 208425541 U 1/2019

* cited by examiner

*Primary Examiner* — Gloria M Hale
(74) *Attorney, Agent, or Firm* — Nitin Kaushik

(57) ABSTRACT

An adjustable bra includes a connecting strap, a first shoulder strap, a second shoulder strap, and a cup. One side of the cup is connected to the connecting strap, and the opposite side is detachably connectable to the first and second shoulder straps. A first avoidance groove for inserting a breast pump is defined on an inner side of the cup at a position corresponding to the left chest, and a second avoidance groove for inserting the breast pump is defined on an inner side of the cup at a position corresponding to the right chest. The detachable connections provide a top opening for inserting or removing the pump.

9 Claims, 4 Drawing Sheets

BRA

CROSS-REFERENCE TO RELATED APPLICATIONS

The application claims priority to Chinese patent application No. 2025208747609, filed on May 6, 2025, the entire contents of which are incorporated herein by reference.

TECHNICAL FIELD

The present application relates to the technical field of clothing, and in particular to a bra.

BACKGROUND

Breastfeeding bra is a brassiere specially designed for parturient during the lactation period. Its main function is to provide support for the breast and help the breast maintain good blood circulation so as to promote milk secretion, enhance the disease resistance of the breast, and effectively protect the nipple from friction and pain. In addition, the breastfeeding bra can provide a comfortable wearing experience for the parturient and meet the special needs of lactation period.

During the lactation period, some puerpera are unable to breastfeed the baby on time due to work or other reasons, and it is usually necessary to use a breast pump to solve the breast swelling problem. The breast pump is a tool used to extract breast milk from the breast, which can help the puerpera to discharge milk in time when the breast swells, avoid breast discomfort, and also facilitate the storage of breast milk for subsequent use by the infant. However, the conventional breastfeeding bra requires the whole bra to be pulled out when the breast pump is used, which causes inconvenience in use of the breast pump.

SUMMARY

Embodiments of the present application provide a bra that solves or alleviates one or more of the technical problems in the prior art.

As one aspect of embodiments of the present application, embodiments of the present application provide a bra including:

a connecting strap;

a first shoulder strap and a second shoulder strap, wherein both ends of the first shoulder strap are respectively connected to the connecting strap, and both ends of the second shoulder strap are respectively connected to the connecting strap;

a cup, wherein one side of the cup is connected to the connecting strap, and the other side of the cup is detachably connected to the first shoulder strap and the second shoulder strap, respectively;

wherein a first avoidance groove for inserting a breast pump is defined on an inner side of the cup at a position corresponding to the left chest; and a second avoidance groove for inserting the breast pump is defined on an inner side of the cup at a position corresponding to the right chest.

In some embodiments, the cup includes an inner garment and a first outer garment; the inner garment is connected to the connecting strap; both sides of the first outer garment are connected to the inner garment, respectively; and the first avoidance groove is formed between the first outer garment and the inner garment.

In some embodiments, the first outer garment is provided on a side of the inner garment facing away from the first shoulder strap.

In some embodiments, the first outer garment is provided with a first clasp; the first shoulder strap is provided with a second clasp; and the first clasp and the second clasp are detachably connected.

In some embodiments, the first clasp defines a first clamp groove and the second clasp is a projection extending away from the connecting strap, the second clasp being clamped in the first clamp groove.

In some embodiments, the cup includes an inner garment and a second outer garment; the inner garment is connected to the connecting strap; both sides of the second outer garment are connected to the inner garment, respectively; and the second avoidance groove is formed between the second outer garment and the inner garment.

In some embodiments, the second outer garment is provided on a side of the inner garment facing away from the second shoulder strap.

In some embodiments, a third clasp is provided on the second outer garment and a fourth clasp is provided on the second shoulder strap, the third clasp and the fourth clasp being detachably connected.

In some embodiments, the third clasp defines a second clamp groove and the fourth clasp is a projection extending away from the connecting strap, the fourth clasp being provided in the second clamp groove.

In some embodiments, both ends of the connecting strap are detachably connected.

The embodiments of the present application have the following advantageous effects.

Based on the bra provided above, the present application can realize the use of the breast pump in two ways, provide a quick opening and closing function for the use of the breast pump, solve the inconvenience of completely detaching the bra when the breast pump is used, facilitate the accurate fitting of the breast pump and the chest, and avoid the influence of the breast pumping effect due to the unstable position or the incomplete fitting of the breast pump, so as to act more efficiently on the target chest area, improve the efficiency of breast pumping, and meet the actual needs of the lactating user.

BRIEF DESCRIPTION OF DRAWINGS

In the drawings, like reference numerals refer to the same or similar parts or elements throughout the several views unless otherwise specified. These drawings are not necessarily drawn to scale. It should be appreciated that these drawings depict only some embodiments in accordance with the disclosure and are not to be considered limiting of the scope of the disclosure.

DESCRIPTION OF REFERENCE NUMERALS

1, bra;

10, connecting strap;

20, first shoulder strap;

30, second shoulder strap;

40, cup; 41, inner garment; 42, first outer garment; 43, first avoidance groove; 44, first clasp; 441, first clamp groove; 45, second clasp; 46, second outer garment; 47, second avoidance groove; 48, third clasp; 481, second clamp groove; 49, fourth clasp; 2, breast pump.

DETAILED DESCRIPTION OF THE EMBODIMENTS

In the following, only certain exemplary embodiments are briefly described. As will be recognized by those skilled in the art, the described embodiments may be modified in various different ways without departing from the spirit or scope of the present application. Accordingly, the drawings and description are to be regarded as illustrative in nature, and not as restrictive.

Figure 1:
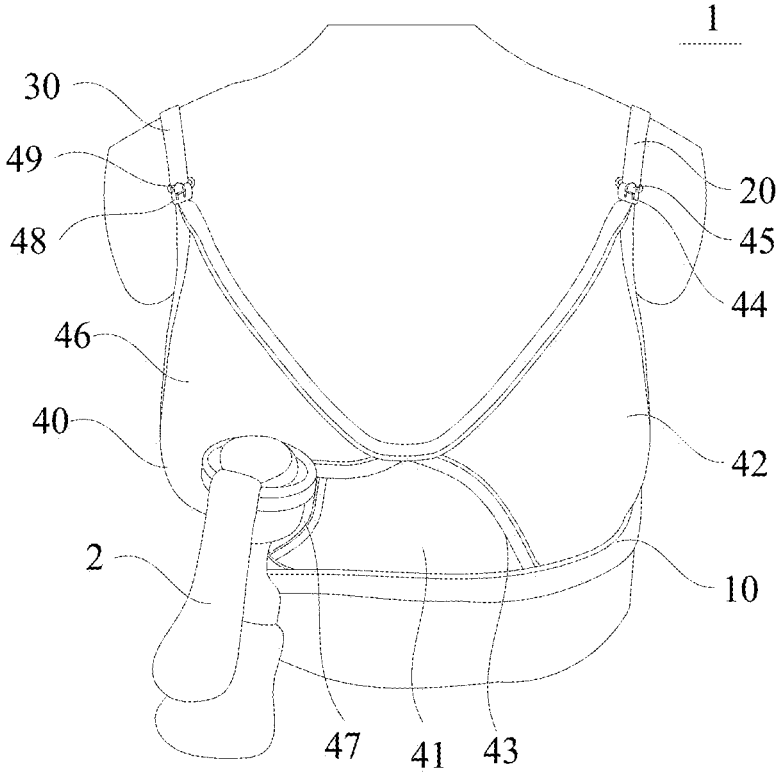
FIG. 1 shows a schematic view of the use of a bra according to an embodiment of the present application.
Figure 2:
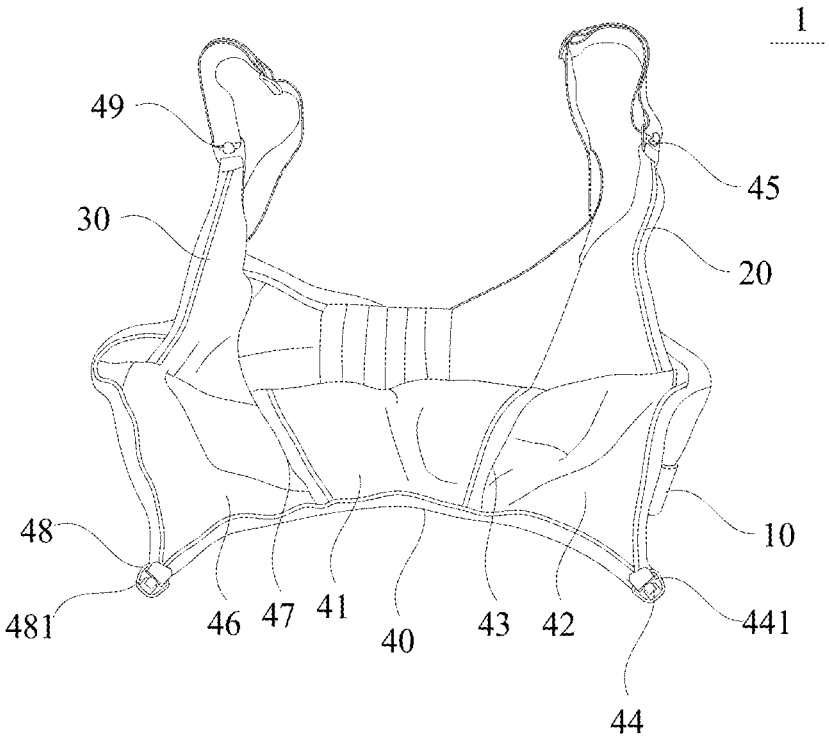
FIG. 2 shows a front view of a bra according to an embodiment of the present application.
Figure 3:
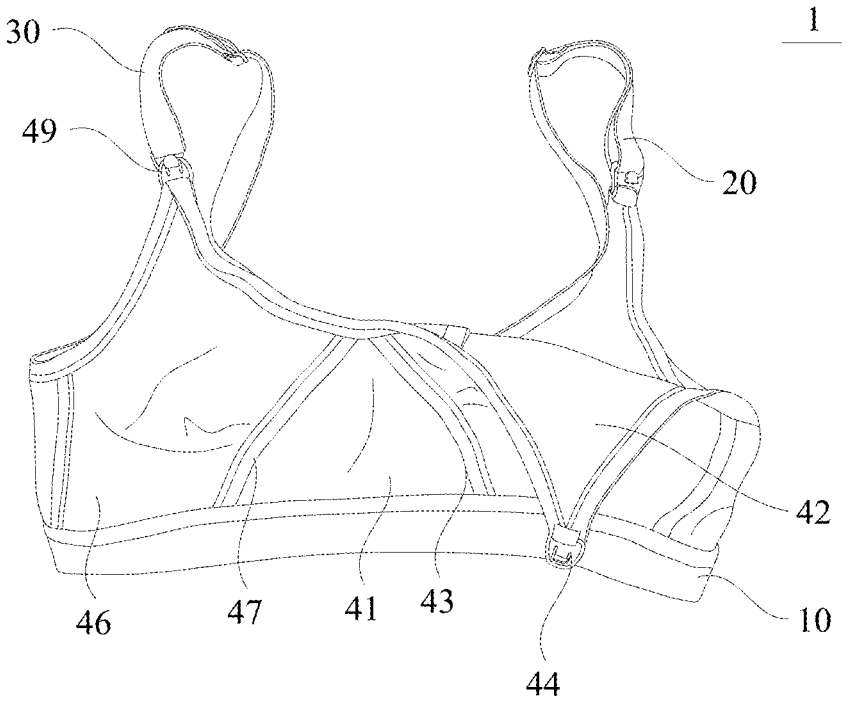
FIG. 3 shows a front view of a bra according to an embodiment of the present application.
Figure 4:
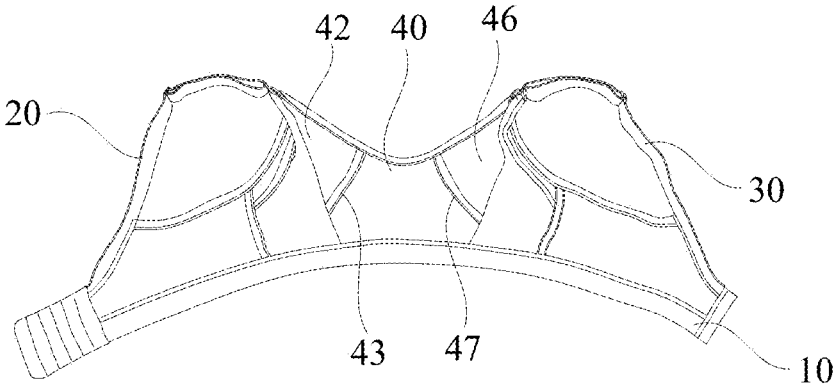
FIG. 4 shows a rear view of a bra according to an embodiment of the present application.

Referring to FIGS. 1 to 4, the embodiment of the present application provides a bra 1 including a connecting strap 10, a first shoulder strap 20, a second shoulder strap 30, and a cup 40. Both ends of the first shoulder strap 20 are respectively connected to the connecting strap 10, and both ends of the second shoulder strap 30 are respectively connected to the connecting strap 10.

In some examples, the first shoulder strap 20 is an elastic strap to enable the first shoulder strap 20 to better conform to the side contours of different chest types. Similarly, the second shoulder strap 30 is an elastic strap to enable the first shoulder strap 20 to better conform to the profile of the sides of different chest types.

One side of the cup 40 is connected to the connecting strap 10, and the other side of the cup 40 is detachably connected to the first shoulder strap 20 and the second shoulder strap 30, respectively.

A first avoidance groove 43 for inserting the breast pump 2 is defined on an inner side of the cup 40 at a position corresponding to the left chest. A second avoidance groove 47 for inserting the breast pump 2 is defined on an inner side of the cup 40 at a position corresponding to the right chest.

In some examples, only the inner side of the cup 40 at a position corresponding to the left chest is defined with a first avoidance groove 43, so that the breast pump 2 can be inserted only into the first avoidance groove 43 to act on the left chest.

In other examples, only the inner side of the cup 40 at a position corresponding to the right chest is defined with the second avoidance groove 47, so that the breast pump 2 can be inserted only into the second avoidance groove 47 to act on the right chest.

In still other examples, the inner side of the cup 40 at a position corresponding to the left chest is defined with a first avoidance groove 43, and the inner side of the cup 40 at a position corresponding to the right chest is defined with a second avoidance groove 47, so that the breast pump 2 can be inserted into the first avoidance groove 43 or the second avoidance groove 47 to act on the left chest and the right chest.

When the bra 1 is worn, the first shoulder strap 20 can be hung on the left shoulder, the second shoulder strap 30 can be hung on the right shoulder, the connecting strap 10 can be wrapped around the body, and both ends of the connecting strap 10 can be connected, thereby realizing the wearing of the bra 1. Second, when the user desires to use the breast pump 2, the cup 40 can be detached from the first shoulder strap 20 or the second shoulder strap 30 to expose the left chest or the right chest, thereby allowing the user to apply the breast pump 2 to the left chest or the right chest and reattach the cup 40 to the first shoulder strap 20 or the second shoulder strap 30 after use of the breast pump 2. Exemplarily, when it is desired to apply the breast pump 2 to the left chest, the cup 40 is detached from the first shoulder strap 20 to expose the left chest, thereby enabling the user to apply the breast pump 2 to the left chest, and to reattach the cup 40 to the first shoulder strap 20 after use of the breast pump 2. When it is desired to use the breast pump 2 on the right chest, the cup 40 is detached from the second shoulder strap 30 to expose the right chest, thereby enabling the user to apply the breast pump 2 to the right chest and to reattach the cup 40 to the second shoulder strap 30 after use of the breast pump 2.

Further, the user can apply the breast pump 2 to the left chest or the right chest by inserting the breast pump 2 into the first avoidance groove 43 or the second avoidance groove 47. Exemplarily, when it is desired to apply the breast pump 2 to the left chest, the breast pump 2 is inserted into the first avoidance groove 43, so that the user can apply the breast pump 2 to the left chest and pull the breast pump 2 out of the first avoidance groove 43 after use of the breast pump 2. When it is desired to use the breast pump 2 on the right chest, the breast pump 2 is inserted into the second avoidance groove 47, so that the user can apply the breast pump 2 to the right chest and pull out the breast pump 2 from the second avoidance groove 47 after use of the breast pump 2.

According to the technology of the present application, the bra 1 of the present application can realize the use of the breast pump 2 in two ways, provide a quick opening and closing function for the use of the breast pump 2, solve the inconvenience of completely detaching the bra 1 when the breast pump 2 is used, facilitate the accurate fitting of the breast pump 2 and the chest, and avoid the influence of the breast pumping effect due to the unstable position or the incomplete fitting of the breast pump 2, so as to act more efficiently on the target chest area, improve the efficiency of breast pumping, and meet the actual needs of the lactating user.

In the embodiment of the present application, the first outer garment 42, the second outer garment 46 and the inner garment 41 are made of an elastic structure.

In some embodiments, referring to FIGS. 1 to 4, the cup 40 includes an inner garment 41 and a first outer garment 42. The inner garment 41 is connected to the connecting strap 10. Both sides of the first outer garment 42 are connected to the inner garment 41, respectively. A first avoidance groove 43 is formed between the first outer garment 42 and the inner garment 41.

Exemplarily, both sides of the first outer garment 42 are connected to the inner garment 41, respectively, so that the first outer garment 42 and the inner garment 41 enclose to form a first avoidance groove 43.

According to the embodiment of the present application, the first avoidance groove 43 can be stably formed by such a layered design, so as to avoid a situation where the first avoidance groove 43 is deformed or cannot be normally used due to an unreasonable structure of the cup 40. At the same time, this design can effectively improve the overall support and aesthetics of the bra 1, and ensure that the bra 1 has a good wearing experience while meeting the functional requirements.

In some embodiments, referring to FIGS. 1 to 4, the first outer garment 42 is provided on a side of the inner garment 41 facing away from the first shoulder strap 20, so that the opening of the first avoidance groove 43 can be provided downwards. When the user needs to use the breast pump 2, the breast pump 2 can be inserted into the first avoidance groove 43 from the bottom to the top, which is more convenient for the user in the disclosure than the way in which the breast pump 2 is inserted into the first avoidance groove 43 from the top to the bottom.

In some embodiments, referring to FIGS. 1-4, the first outer garment 42 is provided with a first clasp 44 and the first shoulder strap 20 is provided with a second clasp 45, with the first clasp 44 and the second clasp 45 being detachably connected to provide a detachable connection between the cup 40 and the first shoulder strap 20.

In some embodiments, referring to FIGS. 1-4, the first clasp 44 defines a first clamp groove 441, and the second clasp 45 is a projection extending away from the connecting strap 10, the second clasp 45 being clamped into the first clamp groove 441.

According to the embodiment of the present application, when it is desired to connect the cup 40 to the first shoulder strap 20, the first clamp groove 441 of the first clasp 44 is clamped into the second clasp 45. When it is required to detach the cup 40 from the first shoulder strap 20, the first clamp groove 441 of the first clasp 44 is detached from the second clasp 45, thereby achieving a detachable connection between the cup 40 and the first shoulder strap 20.

In some embodiments, referring to FIGS. 1 to 4, the cup 40 includes an inner garment 41 and a second outer garment 46. The inner garment 41 is connected to the connecting strap 10. Both sides of the second outer garment 46 are connected to the inner garment 41, respectively. A second avoidance groove 47 is formed between the second outer garment 46 and the inner garment 41.

Exemplarily, both sides of the second outer garment 46 are connected to the inner garment 41, respectively, so that the second outer garment 46 and the inner garment 41 enclose to form a second avoidance groove 47.

According to the embodiment of the present application, the second avoidance groove 47 can be stably formed by such a layered design, so as to avoid a situation where the second avoidance groove 47 is deformed or cannot be normally used due to an unreasonable structure of the cup 40. At the same time, this design can effectively improve the overall support and aesthetics of the bra 1, and ensure that the bra 1 has a good wearing experience while meeting the functional requirements.

In some embodiments, referring to FIGS. 1 to 4, the second outer garment 46 is provided on a side of the inner garment 41 facing away from the second shoulder strap 30, so that the opening of the second avoidance groove 47 can be provided downwards. When the user needs to use the breast pump 2, the breast pump 2 can be inserted into the second avoidance groove 47 from the bottom to the top, which is more convenient for the user in the disclosure than the way in which the breast pump 2 is inserted into the second avoidance groove 47 from the top to the bottom.

In some embodiments, referring to FIGS. 1-4, a third clasp 48 is provided on the second outer garment 46, and a fourth clasp 49 is provided on the second shoulder strap 30, with the third clasp 48 and the fourth clasp 49 being detachably connected to provide a detachable connection between the cup 40 and the second shoulder strap 30.

In some embodiments, the third catch 48 defines a second clamp groove 481, and the fourth catch 49 is a projection extending away from the connecting strap 10, the fourth catch 49 being clamped into the second clamp groove 481.

According to the embodiment of the present application, when it is required to connect the cup 40 to the second shoulder strap 30, the second clamp groove 481 of the third clasp 48 is clamped into the fourth clasp 49. When it is required to detach the cup 40 from the second shoulder strap 30, the second clamp groove 481 of the third clasp 48 is detached from the fourth clasp 49, thereby achieving a detachable connection between the cup 40 and the second shoulder strap 30.

In some embodiments, both ends of the connecting strap 10 are detachably connected.

In some embodiments, the first outer garment 42, the second outer garment 46, and the inner garment 41 are integrally provided.

According to the bra 1 of the present application, the bra 1 of the present application can realize the use of the breast pump 2 in two ways, provide a quick opening and closing function for the use of the breast pump 2, solve the inconvenience of completely detaching the bra 1 when the breast pump 2 is used, facilitate the accurate fitting of the breast pump 2 and the chest, and avoid the influence of the breast pumping effect due to the unstable position or the incomplete fitting of the breast pump 2, so as to act more efficiently on the target chest area, improve the efficiency of breast pumping, and meet the actual needs of the lactating user.

In the description, it should be understood that the directional or positional relationships indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", and the like are based on the directional or positional relationships shown in the drawings. It is merely for the purpose of describing the present application and simplifying the description, and is not intended to indicate or imply that a particular orientation, configuration and operation of the referenced device or element is required and should not be construed as limiting the scope of the present application.

Furthermore, the terms "first" and "second" are used for descriptive purposes only and are not to be construed as indicating or implying relative importance or implicitly indicating the number of technical features indicated. Thus, a feature defined by "first" or "second" may explicitly or implicitly include one or more of the features. In the description of the present application, the meaning of "a plurality" is two or more, unless specifically limited otherwise.

In the present application, unless expressly stated or limited otherwise, the terms "mounted", "connected", "connecting", "fixed", and the like are to be interpreted broadly, e.g., either fixedly or removably, or integrally modularization. It may be a mechanical connection, an electrical connection, or a communication. It may be a direct connection or indirect connection by an intermediary. It may be a communication between two elements, or may be in an interactive relationship between two elements. For those of ordinary skill in the art, the specific meanings of the above terms in the the present application can be understood according to specific circumstances.

In the present application, unless expressly stated or limited otherwise, reference to a first feature as being "on" or "under" a second feature may include reference to the first and second features being in direct contact, as well as reference to the first and second features not being in direct contact but being in contact by additional features between them. Further, the first feature being "above", "over", and "on the top of" the second feature includes the first feature being directly above and obliquely above a second feature, or merely indicates that the first feature is at a higher level than the second feature. The first feature being "below", "below", and "at the bottom of" the second feature includes the first feature being directly below and diagonally below the second feature, or merely indicates that the first feature is at a lower level than the second feature.

The above disclosure provides many different implementations or examples for implementing different structures of the present application. To simplify the disclosure of the present application, components and arrangements of particular examples have been described above. They are, of course, merely examples and are not intended to limit the present application. Further, the present application may repeat reference numerals and/or reference letters in different instances, such repetition being for the purpose of simplicity and clarity and not in itself indicative of a relationship between the various embodiments and/or arrangements discussed.

Although only the specific implementations of the present application have been described above, the scope of the present application is not limited thereto, and any changes or substitutions which can be easily conceived by those skilled in the art within the technical scope disclosed in the present application should be covered by the present application. Accordingly, the scope of protection of the present application shall be subject to the scope of protection of the claims.

What is claimed is:

1. A bra, comprising:

a connecting strap;

a first shoulder strap and a second shoulder strap, wherein both ends of the first shoulder strap are respectively connected to the connecting strap, and both ends of the second shoulder strap are respectively connected to the connecting strap;

a cup, wherein one side of the cup is connected to the connecting strap, and the other side of the cup is detachably connected to the first shoulder strap and the second shoulder strap, respectively;

wherein a first avoidance groove for inserting a breast pump is defined on an inner side of the cup at a position corresponding to the left chest; and a second avoidance groove for inserting the breast pump is defined on an inner side of the cup at a position corresponding to the right chest, wherein the cup comprises an inner garment and a first outer garment; the inner garment is connected to the connecting strap; both sides of the first outer garment are connected to the inner garment, respectively; and the first avoidance groove is formed between the first outer garment and the inner garment.

2. The bra according to claim 1, wherein the first outer garment is provided on a side of the inner garment facing away from the first shoulder strap.

3. The bra according to claim 2, wherein the first outer garment is provided with a first clasp; the first shoulder strap is provided with a second clasp; and the first clasp and the second clasp are detachably connected.

4. The bra according to claim 3, wherein the first clasp defines a first clamp groove and the second clasp is a projection extending away from the connecting strap, the second clasp being clamped in the first clamp groove.

5. The bra according to claim 1, wherein the cup comprises an inner garment and a second outer garment; the inner garment is connected to the connecting strap; both sides of the second outer garment are connected to the inner garment, respectively; and the second avoidance groove is formed between the second outer garment and the inner garment.

6. The bra according to claim 5, wherein the second outer garment is provided on a side of the inner garment facing away from the second shoulder strap.

7. The bra according to claim 6, wherein a third clasp is provided on the second outer garment and a fourth clasp is provided on the second shoulder strap, the third clasp and the fourth clasp being detachably connected.

8. The bra according to claim 7, wherein the third clasp defines a second clamp groove and the fourth clasp is a projection extending away from the connecting strap, the fourth clasp being provided in the second clamp groove.

9. The bra according to claim 1, wherein both ends of the connecting strap are detachably connected.

* * * * *